United States Patent [19]

May

[11] 4,286,566

[45] Sep. 1, 1981

[54] ENGINE SYSTEM

[75] Inventor: William S. May, High Wycombe, England

[73] Assignee: Lucas Industries Limited, Birmingham, England

[21] Appl. No.: 139,900

[22] Filed: Apr. 14, 1980

[30] Foreign Application Priority Data

Jun. 8, 1979 [GB] United Kingdom ..... 19984/79

[51] Int. Cl.[3] ..... F02M 25/06

[52] U.S. Cl. ..... 123/569

[58] Field of Search ..... 123/569, 571

[56] References Cited

U.S. PATENT DOCUMENTS

| | | | |
|---|---|---|---|
| 3,915,134 | 10/1975 | Young et al. | 123/569 |
| 3,916,857 | 11/1975 | Naito et al. | 123/569 |
| 4,020,809 | 3/1977 | Kern et al. | 123/569 |
| 4,043,304 | 8/1977 | Stumpp et al. | 123/569 |
| 4,181,109 | 1/1980 | Wake et al. | 123/569 |
| 4,192,267 | 5/1980 | Cobb | 123/569 |

FOREIGN PATENT DOCUMENTS

| | | | |
|---|---|---|---|
| 2658052 | 7/1978 | Fed. Rep. of Germany | 123/569 |

*Primary Examiner*—Wendell E. Burns

[57] ABSTRACT

An engine system includes a compression ignition engine having an exhaust gas recirculation system incorporating a spindle mounting a valve. A fuel pump having a fuel lever supplies fuel to the engine and the spindle is connected to a control means which reduces the amount of exhaust gas recirculated as the fuel supply to the engine is increased. The control means is slow acting and in order to reduce the amount of exhaust gas recirculated in the event of a rapid movement of the control lever in a direction to increase the fuel, a linkage is provided connecting the control lever to the spindle. The linkage incorporates a piston cylinder combination which transmits rapid movement of the control lever to the spindle only when the control lever is moved to effect an increase in fuel.

4 Claims, 3 Drawing Figures

ENGINE SYSTEM

This invention relates to an engine system comprising a compression ignition engine, a fuel pump for supplying fuel to the engine in timed relationship therewith, a manually operable control member for controlling the rate at which fuel is supplied by the pump in use, conduit means through which exhaust gases can flow from the engine exhaust to the air inlet thereof, valve means for controlling the flow of exhaust gas through said conduit means, and control means for determining the setting of said valve means whereby in use, as the rate at which fuel is supplied to the engine increases the quantity of exhaust gas passing to the air inlet is reduced.

Such systems are known in which the control means is responsive to one or more fuel pressures within the fuel pump. With this arrangement it has been found that the adjustment of the valve means following movement of the control member to increase the rate of fuel flow, can take an appeciable time in the result that when the rate of fuel flow has increased an excessive amount of exhaust gas is being supplied to the air inlet of the engine. As a result the ratio of fuel to air in the charge in the cylinder is excessive so that smoke appears in the engine exhaust. The resulting emission of smoke lasts only until the control means corrects the setting of the valve means, nevertheless, it is objectionable and also may infringe anti-pollution laws. The object of the present invention is to provide such a system in a simple and convenient form.

According to the invention a system of the kind specified comprises means operable upon movement of said control member in a direction to increase fuel, to effect immediate operation of said valve means to reduce the amount of exhaust gas flowing to the air inlet.

An example of an engine system in accordance with the invention will now be described with reference to the accompanying drawings in which.

Figure 1:
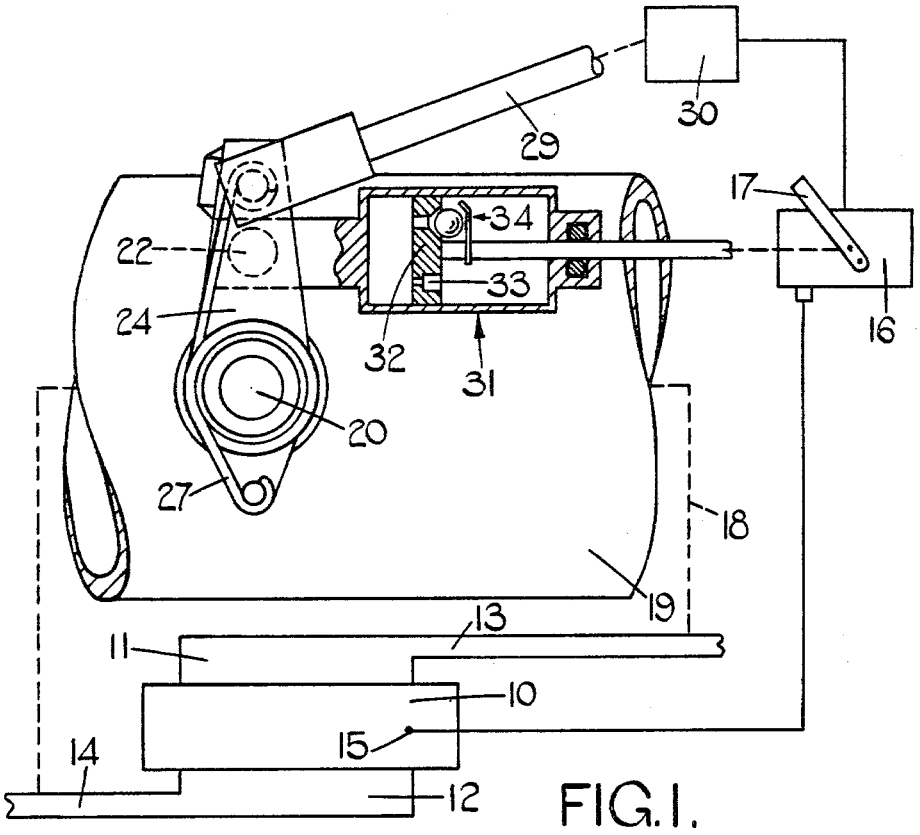
FIG. 1 shows in diagrammatic form the essential components of the system.

Referring to FIG. 1 of the drawings a compression ignition engine is indicated at 10 having an exhaust manifold 11 and an air inlet manifold 12. The exhaust manifold is connected to the exhaust pipe 13 of the engine whilst the air inlet manifold is connected to an air inlet 14. A turbo-charger may be incorporated to supply air under pressure to the air inlet. Fuel is supplied to injection nozzles 15 only one of which is shown, by means of a fuel pump 16 and this is provided with a manually operable control member 17 adjustment of which effects variation in the rate of fuel supply to the engine.

Figure 2:
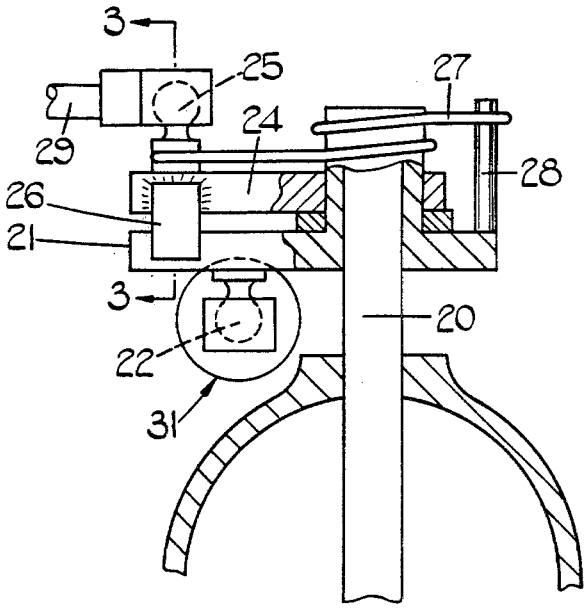
FIG. 2 shows one component of the system in side elevation.
Figure 3:
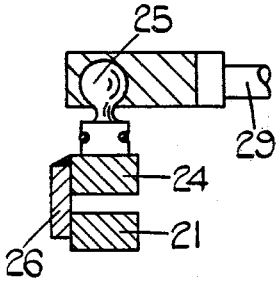
FIG. 3 is a section on the line 3—3 of FIG. 2.

Conduit means indicated at 18 is connected between the exhaust pipe 13 and the air inlet 14 and includes a pipe 19 in which is mounted a butterfly valve which is carried on a spindle 20 extending diametrically through the pipe. As shown in FIGS. 2 and 3 a first lever 21 is secured to the spindle 20 and the first lever mounts a spherical ball 22. A second lever 24 is mounted about the spindle 20 but is not rigidly secured thereto. The second lever 24 mounts a further spherical ball 25 moreover, the second lever 24 mounts an abutment 26 which extends downwardly for contact with the lever 21 and the abutment is maintained in the free condition, in contact with the lever 21 by means of a spring 27 one end of which bears the mounting for the ball 25 and the other end of which bears against an up-standing abutment 28 carried by the lever 21. The ball 25 is connected to one end of a link 29 the other end of which is connected to or forms the output member of the control means 30. The control means 30 which may include a servo arrangement, is responsive to a fuel pressure within the pump 16 whereby when the lever 17 is moved by an operator to increase the amount of fuel supply to the associated engine, the control means moves the valve to reduce the amount of exhaust gas flowing from the exhaust pipe to the air inlet and vice versa. The linkage may be arranged such that movement of the lever 17 so as to provide maximum fuel to the engine will also be sufficient to close the valve completely.

Since the control means is responsive to a fuel pressure, there will be a delay in its operation and the situation can arise in which the lever 17 is moved quickly to increase the amount of fuel supplied to the engine but there is a delay in the movement of the butterfly valve to reduce the amount of exhaust gas which is re-circulated. As a result the fuel/air ratio in the charge in the cylinder of the engine will increase to the point where smoke will appear in the exhaust of the engine. This is of a temporary nature only until the control means effects movement of the butterfly valve. Nevertheless, it is objectionable and may infringe the anti-pollution laws.

In order to minimise the risk of smoke, the aforesaid first lever 21 is connected by linkage to the control lever 17 with the practical effect that when the lever 176 is moved to increase the amount of fuel the butterfly valve is moved to reduce the amount of exhaust gas recirculated. The linkage which connects the lever 21 to the lever 17 includes a piston cylinder combination 31, the piston 32 being connected by means of a piston rod to the lever 17 whilst the cylinder is connected to the ball 22. A restricted passage 33 is provided in the piston and a one way valve 34 is also provided. In operation, when the lever 17 is moved to increase the amount of fuel supplied to the engine by imparting clockwise movement as shown in FIG. 1, the piston moves toward the right and the non return valve 34 closes and as a result a fluid pressure is generated on the right hand side of the piston which causes the cylinder to move in the same direction. Thus the lever 21 is moved angularly in a direction to close the butterfly valve the spring 27 being tensioned in the process. By virtue of the restrictor 33 however the fluid pressure at the right hand side of the piston will gradually fall as the tension in spring 27 diminishes as lever 21 and abutmemt 26 come together. By this time the control means 30 will have operated to move the lever 24 to its new and correct position. Such movement may involve further movement of the lever 21 in the direction to close the butterfly valve. When the lever 17 is moved to reduce the rate of delivery of fuel to the engine the piston will be moved towards the left and the non return valve will open so that a build up of pressure on the left hand side of the piston is avoided. The control means 30 can then set the butterfly valve to its correct position the movement of the cylinder relative to the piston being allowed by the flow of liquid through the restrictor 33.

I claim:

1. An engine system comprising a compression ignition engine, a fuel pump for supplying fuel to the engine in timed relationship therewith, a manually operable control member for controlling the rate at which fuel is supplied by the pump in use, conduit means through which exhaust gases can flow from the engine exhaust to the air inlet thereof, valve means for controlling the flow of exhaust gas through said conduit means, control means for determining the setting of said valve means whereby in use, as the rate at which fuel is supplied to the engine increases the quantity of exhaust gas passing to the air inlet is reduced, and means operable upon movement of said control member in a direction to increase fuel, to effect immediate operation of said valve means to reduce the amount of exhaust gas flowing to the air inlet.

2. A system according to claim 1 in which said means comprises a linkage including a piston cylinder combination, said piston cylinder combination including restricted passage means to permit displacement of fluid between the ends of the cylinder at a restricted rate, and a non-return valve in a passage connecting the ends of the cylidner, said non-return valve closing during movement of said control member in a direction to increase the amount of fuel supplied to the engine.

3. A system according to claim 2 in which said valve means includes a valve spindle, a first lever connected to said spindle and to said control means, a second lever movable angularly about the axis of said spindle, an abutment mounted on said second lever and engageable with said first lever, and resilient means acting between said levers and acting to urge the abutment into engagement with said first lever.

4. A system according to any one of the preceding claims in which said control means is responsive to a fuel pressure within the fuel pump.

* * * * *